US006283080B1

(12) United States Patent
Tsunoda et al.

(10) Patent No.: US 6,283,080 B1
(45) Date of Patent: Sep. 4, 2001

(54) VERTICAL INTERNAL COMBUSTION ENGINE

(75) Inventors: Masaki Tsunoda; Shigekazu Sakata, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/631,684

(22) Filed: Aug. 2, 2000

Related U.S. Application Data

(62) Division of application No. 08/992,255, filed on Dec. 17, 1997, now Pat. No. 6,116,197.

(30) Foreign Application Priority Data

| | | |
|---|---|---|
| Dec. 19, 1996 | (JP) | 8-354565 |
| Feb. 3, 1997 | (JP) | 9-020870 |
| Feb. 3, 1997 | (JP) | 9-020871 |
| Feb. 3, 1997 | (JP) | 9-034329 |

(51) Int. Cl.[7] ..... F02B 75/06
(52) U.S. Cl. ..... 123/192.2; 123/196 W
(58) Field of Search ..... 123/192.2, 196 R, 123/196 W, 195 HC

(56) References Cited

U.S. PATENT DOCUMENTS

| | | | | |
|---|---|---|---|---|
| 4,690,111 | * | 9/1987 | Kohno et al. | 123/192.2 |
| 4,819,505 | * | 4/1989 | Takubo et al. | 123/192.2 |
| 4,846,124 | | 7/1989 | Suzuki et al. . | |
| 5,156,068 | * | 10/1992 | Moller | 123/192.2 |
| 5,253,547 | * | 10/1993 | Yoneyama et al. | 123/199.2 |
| 5,375,571 | * | 12/1994 | Diehl et al. | 123/192.2 |
| 5,537,968 | | 7/1996 | Takahashi . | |
| 5,873,330 | | 2/1999 | Takahashi et al. . | |

FOREIGN PATENT DOCUMENTS

| | | |
|---|---|---|
| 0 487 960 A1 | 6/1992 | (EP) . |
| 0 705 966 A1 | 4/1996 | (EP) . |
| 63-192693 | 8/1988 | (JP) . |
| 3-33416 | 2/1991 | (JP) . |
| 3-224894 | 10/1991 | (JP) . |
| 4-337143 | 11/1992 | (JP) . |
| 7-149290 | 6/1995 | (JP) . |
| 8-100616 | 4/1996 | (JP) . |

* cited by examiner

*Primary Examiner*—John Kwon
(74) *Attorney, Agent, or Firm*—Armstrong, Westerman, Hattori, McLeland & Naughton, LLP

(57) ABSTRACT

A vertical internal combustion engine for an outboard motor having a crankshaft directed substantially in a vertical direction contains a flywheel provided integrally on a lower end of the crankshaft and an oil pan provided under the flywheel. A lubricating oil pump driven by the crankshaft to rotate is disposed under the flywheel, and in the internal combustion engine, the center of gravity is positioned low so that the flywheel can be supported stably and the dischagrability of the lubricating oil pump will be high. Moreover, a pair of balancer shafts connected to the crankshaft to be driven thereby is disposed in parallel with the crankshaft on both sides of the engine cylinders, and balancer shaft lubricating oil passages are provided for lubricating balancer shaft pivot portions.

3 Claims, 15 Drawing Sheets

VERTICAL INTERNAL COMBUSTION ENGINE

This application is a division of prior application Ser. No. 08/992,255 filed Dec. 17, 1997 now U.S. Pat. No. 6,116,197.

BACKGROUND OF THE INVENTION

The present invention relates to a vertical internal combustion engine having a crankshaft directed substantially in a vertical direction, particularly a vertical internal combustion engine for an outboard motor.

In a 4-stroke cycle vertical internal combustion engine disclosed in Japanese Laid-Open Patent Publication No. Hei 7-149290, a flywheel is provided on a lower end of a crankshaft directed in a vertical direction integrally and a lubricating oil pump is disposed above the flywheel. Further, at a position above the flywheel, a drive gear is provided on the crankshaft integrally and a speed increasing mechanism is interposed between the drive gear and the lubricating oil pump so that the lubricating oil pump is rotationally driven at a higher speed than that of the crankshaft.

In a 4-stroke cycle vertical internal combustion engine disclosed in Japanese Laid-Open Patent Publication No. Hei 8-100616, a lubricating oil pump is directly connected to a lower end of a cam shaft directed vertically.

According to the engine disclosed in the above-mentioned Japanese Publication No. Hei 7-149290, since the lubricating oil pump rotates at a higher speed than the crankshaft, even if the lubricating oil pump is small-sized, a high discharge ability is obtainable. However, owing to the lubricant oil pump positioning below a bearing portion of the internal combustion engine for pivotally supporting the crankshaft, a part of the crankshaft extending downward from the bearing portion becomes long so that it is difficult to support the flywheel having a large inertial mass stably from a viewpoint of vibration.

According to the engine disclosed in the above-mentioned Japanese Publication No. Hei 8-100616, since no lubricating oil pump is disposed above the flywheel, the flywheel can be arranged near the internal combustion engine and as the result the flywheel having large inertial mass can be supported stably. However, since rotational speed of the cam shaft is a half of that of the crankshaft, there are inconveniences that the discharge ability is low and the lubricating oil pump becomes large necessarily.

Some vertical internal combustion engines for outboard motors in which balancer shafts are used for reducing vibration are disclosed in Japanese Laid-Open Patent Publications Nos. Sho 63-192693, Hei 3-224894and Hei 4-337143.

The Japanese Publication 63-192693and 3-224894disclose balancer mechanisms for offsetting and reducing the primary vibration in an in-line 2-cylinder 4-stroke cycle internal combustion engine.

On the one hand, the Japanese Publication 4-337143discloses a balancer mechanism in a 4-stroke cycle in-line 4-cylinder engine which aims at reducing the secondary vibration because the engine has an advantage that the primary vibration does not occur fundamentally. However, as secondary vibration becomes larger, the balancer becomes large-sized more and it becomes necessary to care about balancer shaft supporting constructions and lubricating passages.

The Japanese Laid-Open Patent Publication No. Hei 3-33416 discloses a water-cooled 4-stroke cycle internal combustion engine for propelling ships in which a suction system is arranged on one side and an exhaust system and a cartridge type oil filter are arranged on another side. As shown in FIG. 8 of the above publication, lubricating oil having passed through the oil filter is supplied to a cam shaft pivot portion through some oil passages to lubricate the cam shaft pivot portion.

In a water-cooled 4-stroke cycle internal combustion engine for propelling ships disclosed by the Japanese Laid-Open Patent Publication No. Hei-8-100616 too, a lubricating oil passage connected between an oil filter disposed near a suction system on a front face of a crankcase and a valve moving system is arranged on the side of an exhaust system.

However, in the internal combustion engine of the publication 3-33416, an electric parts box as well as the oil filter cartridge is disposed on the side of the exhaust system and therefore if the electric parts box becomes large for meeting demands to electric control system, it is difficult to dispose the oil filter cartridge at the same position.

In the internal combustion engine of the publication 8-100616, the oil filter is disposed on a front face of the crankcase and maintenance work is easy. But since an oil passage for lubricating oil after passing through the oil filter is provided in a exhaust system, the oil passage is long to increase flow resistance, capacity of the oil pump has to be improved and amount of oil is necessarily increased.

SUMMARY OF THE INVENTION

An object of the present invention is to provide a vertical 4-stroke internal combustion engine enabling a better arrangement of a flywheel and a lubricating oil pump. Another object of the present invention is to provide an outboard motor having such an internal combustion engine mounted. A further object of the present invention is to provide such an internal combustion engine having a lubricating device suitable for providing a balancer mechanism.

According to the present invention, there is provided a vertical internal combustion engine having a crankshaft directed substantially in a vertical direction, a flywheel provided on a lower end of the crankshaft integrally and an oil pan provided under the flywheel, wherein a lubricating oil pump driven by the crankshaft to rotate is disposed under the flywheel.

The flywheel is positioned close by the main body of the internal combustion engine so that the flywheel is supported stably irrespective of any variation of its rotational speed.

In the above internal combustion engine, a rotor of the lubricating oil pump may be positioned on a lower portion of the crankshaft and driven to rotate together with the crankshaft. According to this engine, a driving system of the lubricating oil pump can be simplified and weight lightening and reduced cost can be achieved. In addition, because the lubricating oil pump can be rotated at the same rotational speed as the crankshaft, discharge ability of the lubricating oil pump can be improved without making the lubricating oil pump large-sized.

According to another aspect of the present invention, there is provided a 4-stroke cycle vertical internal combustion engine, having an internal combustion engine main body housing a crankshaft directed substantially in a vertical direction; a flywheel provided on a lower end of the crankshaft integrally; an oil pump body forming a flywheel chamber for housing the flywheel; a oil pan disposed below the flywheel; a mount case separated from the oil pump body and having a return oil passage arranged below the oil pump body for returning lubricating oil from the internal combustion engine main body to the oil pan and a lubricating oil passage for gathering lubricating oil which has lubricated the crankshaft from a periphery of the pump body toward a center of the crankshaft and returning the lubricating oil to the oil pan; and a lubricating oil pump disposed under the oil pump body.

According to this engine, when the lubricating oil pump is disassembled for maintenance, the flywheel and the oil pump body are not required to be removed, so that disassembling and assembling work can be carried out efficiently and easily.

Further, since the flywheel chamber can be closed, adhesion of lubricating oil to the flywheel can be prevented so that a loss of power and deterioration of the lubricating oil can be avoided.

The mount case may be connected to an under surface of the internal combustion engine main body oil-tightly surrounding the oil pump body to enable smoother return of the lubricating oil.

By using the above vertical internal combustion engine of the present invention as an engine for an outboard motor having cylinders arranged substantially along a lengthwise plane of a ship, it is possible to lower the center of gravity of the outboard motor by lowering position of the internal combustion engine for improving stability of the ship.

According to the other aspect of the present invention, there is provided a vertical internal combustion engine having a crankshaft directed substantially in a vertical direction and a plurality of cylinders arranged along a vertical plane including the crankshaft, comprising a pair of balancer shafts connected to the crankshaft to be driven, pivotally supported in a cylinder block and disposed in parallel with the crankshaft on both sides of the cylinders; pivot holes for pivotally supporting the balancer shaft formed at uppermost and middle crankshaft supporting portions of the cylinder block passing through the crankshaft supporting portions; a work hole for working the pivot holes formed at a lowermost crankshaft supporting portion of the cylinder block positioned on a center line of the pivot holes; and a plug closing the work hole tightly.

In this vertical internal combustion engine, the balance shaft extends as long as the crankshaft to absorb inertia forces and unbalanced moments of inertia in each of the cylinders arranged vertically so that vibration of the internal combustion engine can be reduced sufficiently. Since the balancer shafts are disposed on both sides of the cylinders, the internal combustion engine can be miniaturized in its entirety.

Further, since the balancer shaft pivot holes and the work hole are provided in parallel with the crankshaft passing through the cylinder block, these holes can be machined easily. A tip end of a finishing tool is guided and supported by the work hole so that work for finishing the balancer shaft pivot holes can be carried out surely and efficiently.

In the above-mentioned vertical internal combustion engine, a lubricating oil supply means may be provided at the pivot hole of the uppermost crankshaft supporting portion. In this engine, lubricating oil supplied to the uppermost balancer shaft pivot hole goes down by gravity, after it lubricates the uppermost balancer shaft pivot hole and the balancer shaft, to lubricate the middle balancer shaft pivot holes arranged above and below in turn so that each balancer shaft can be lubricated by only one lubricating oil supply means surely and the lubricating supply construction of the balancer shaft is significantly simplified to enable cost down.

According to the above-mentioned vertical internal combustion engine wherein the lowermost crankshaft supporting portion is divided into an upper wall and a lower wall between which an oil passage space is interposed, the lower wall extends radially slanting downward and only the work hole of the lower wall is closed by the plug, the lubricating oil going down through a space within the cylinder block is led into the oil passage space from an upper surface of the divided upper wall through the work hole thereof, then flows in a radial direction along an upper surface of the divided lower wall to flow down to a periphery of the mount case. Further, a balancer shaft driving means for transmitting power from the crankshaft to the balancer shaft can be disposed so as not to interfere with the flywheel and the power shaft under the cylinder block as well as the lubricating oil.

According to a further aspect of the present invention, there is provided a water-cooled 4-stroke cycle internal combustion engine for propelling ships having a cylinder head and a cylinder block, comprising a plurality of connecting bolts for detachably connecting the cylinder head with the cylinder block arranged around a cylinder with substantially equal distances from a center axis of the cylinder; an exhaust passage formed in the cylinder head positioned on one side of the cylinder, opening on a connecting face to the cylinder block; a cooling water passage disposed around the exhaust passage in the cylinder head, opening on the connecting face; an exhaust passage formed in the cylinder block positioned on the above-mentioned one side of the cylinder, opening on a connecting face to the cylinder head to communicate with the exhaust passage in the cylinder head; a cooling water passage disposed around the exhaust passage in the cylinder block, opening on the connecting face to the cylinder head to communicate with the cooling water passage in the cylinder head; a lubricating oil passage formed in the cylinder head positioned on another side of the cylinder, opening on the connecting face to the cylinder block; and a lubricating oil passage formed in the cylinder block positioned on the above-mentioned another side of the cylinder, opening on the connecting face to the cylinder head to communicate with the lubricating oil passage in the cylinder head.

The periphery of the exhaust passage which is heated by exhaust passing through is cooled by the cooling water passage to suppress heat transfer to other parts of the cylinder head and the cylinder block, and temperature rising of the lubricating oil in the lubricating oil passage arranged on the side opposite to the exhaust passage can be prevented considerably.

Further, even if the connecting faces of the cylinder head and the cylinder block become narrow as a result of cylinder diameter being increased for improving output of the internal combustion engine, the cylinder head and the cylinder block are connected uniformly by the connecting bolts arranged around the cylinder with substantially equal distances from a center axis of the cylinder so that tightness of a gasket inserted between the connecting faces is kept at a predetermined high level all over the peripheral edge round the cylinder.

DETAILED DESCRIPTION OF THE PREFERRED EMBODIMENT

The drawings show a preferred embodiment of the present invention.

Figure 1:
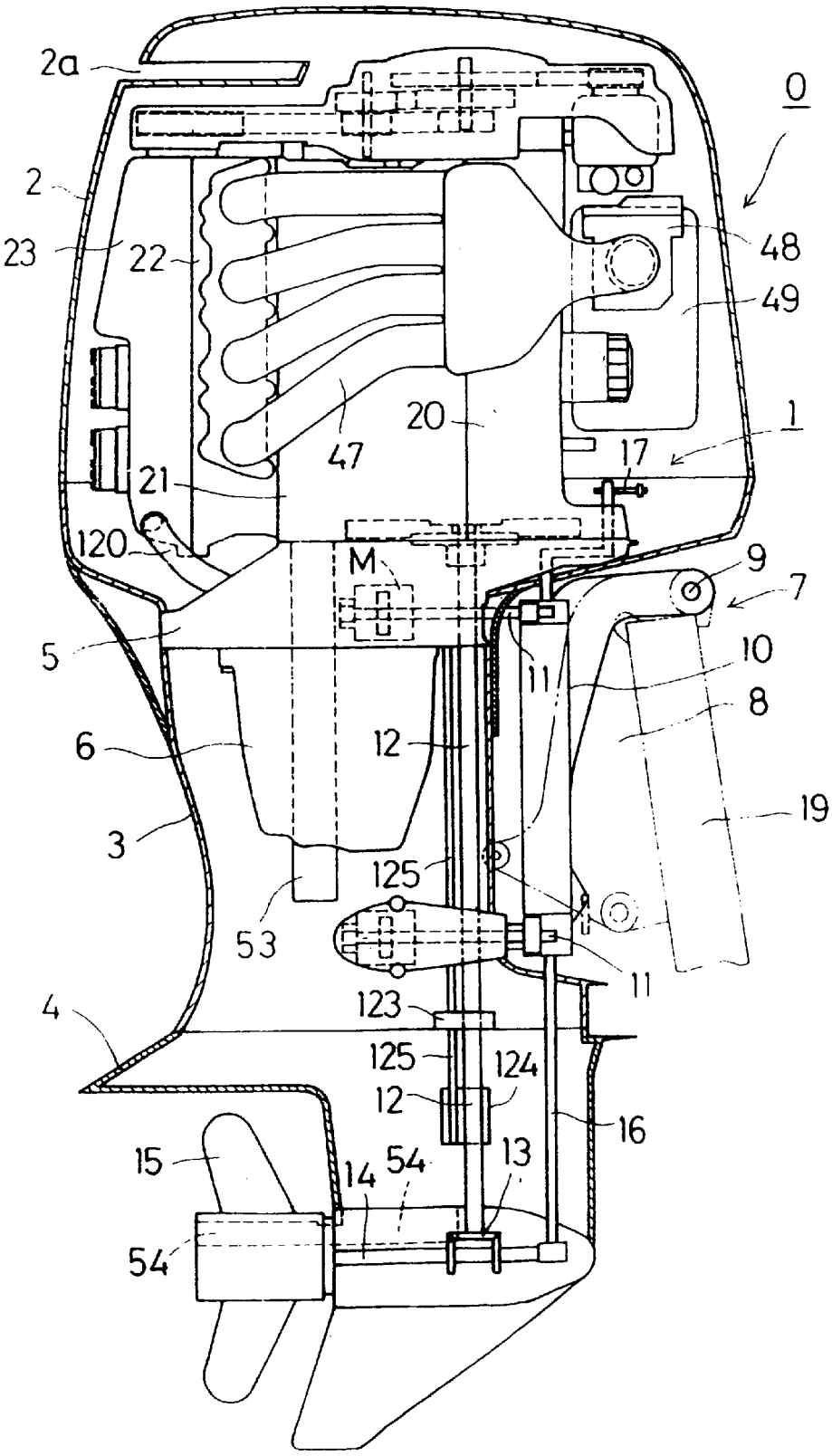
FIG. 1 is a vertical sectional side view of an outboard motor having a vertical internal combustion engine according to the present invention.

The vertical internal combustion engine 1 according to the present invention is a in-line 4-cylinder, water-cooled, 4-stroke cycle internal combustion engine which has a crankshaft 30 directed vertically and cylinders 32 directed rearward with respect to a ship body. As shown in FIG. 1, the engine 1 is mounted on an outboard motor 0 which has a main case comprising an engine cover 2 covering the vertical internal combustion engine 1, an extension case 3 and a gear case 4. Under the vertical internal combustion engine 1, a mount case 5 and a oil pan 6 are piled in order and integrally connected to the vertical internal combustion engine 1.

The outboard motor 0 is attached to a stern 19 of a motorboat not shown by means of an attachment device 7 which comprises a bracket 8 fixed to the stern 19, a tilt shaft 9 laterally laid on an upper end of the bracket 8, a swivel case 10 having a front end pivoted on the tilt shaft 9 so as to swing vertically, and connecting means 11 provided at upper and lower parts of a revolving portion of the swivel case 10 and having mounts M.

A steering handle not shown is provided at the revolving portion of the swivel case 10 and the swivel case is revolved right and left together with the outboard motor 0 when the steering handle is operated to swing right and left.

To a lower end of the crankshaft directed vertically is integrally connected a driving shaft 12 which extends within the extension case 2 downward and reaches the interior of the gear case 4. A lower end of the driving shaft 12 is connected to a propeller shaft 14 through an ahead-astern change over device 13 in the gear case 4. Therefore, power of the vertical combustion engine 1 is transmitted to the propeller 15 through the crankshaft 30, the driving shaft 12, the ahead-astern change over device 13 and the propeller shaft 14 to drive the propeller 15 rotationally.

A normal-reverse manipulating shaft 16 extends downward passing through the swivel case 10 vertically and reaches the ahead-astern change over device 13. When a manipulating lever 17 at an upper end of the normal-reverse manipulating shaft 16 is swung right and left, the ahead-reverse change over device 13 is changed over to rotate the propeller 15 in a normal or reverse direction.

The main body of the vertical internal combustion engine 1 is constituted of a crankcase 20, a cylinder block 21, a cylinder head 22, a head cover 23, the mount case 5 and the oil pan 6. These crankcase 20, cylinder block 21, cylinder head 22 and head cover 23 are arranged from front to rear in order with respect to the ship body, and connected to each other in one body by bolts 24, 25, 26, 28 as shown in FIGS. 6 to 9. As mentioned above, at under surfaces of the crankcase 20 and the cylinder block 21, the mount case 5 and the oil pan 6 are integrally connected to the crankcase 20 and the cylinder block 21 by bolts not shown.

Figure 4:
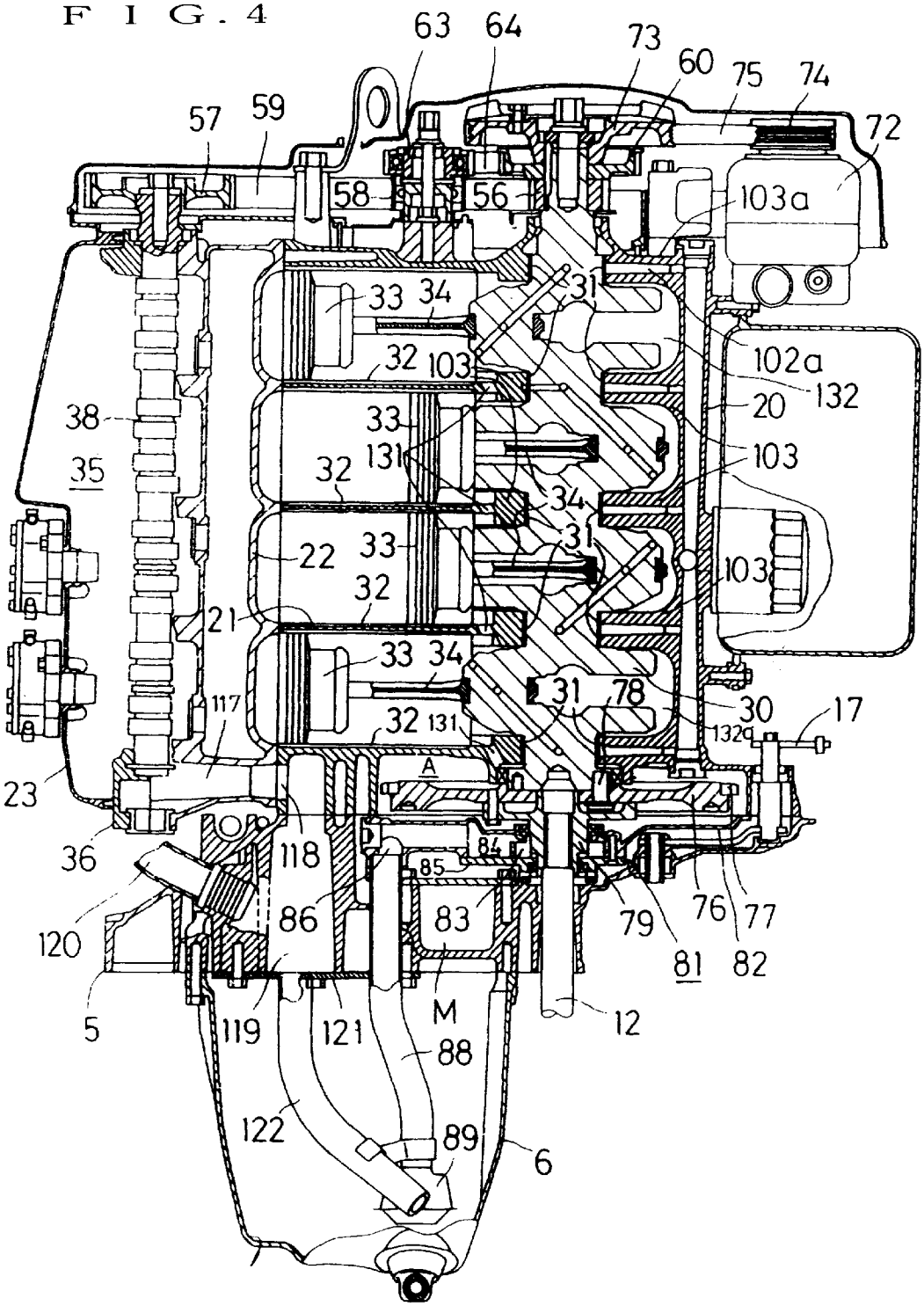
FIG. 4 is a vertical sectional side view of the internal combustion engine.

As shown in FIG. 4, the crankshaft 30 directed vertically is rotationally supported at crankshaft supporting portions 103 of the crankcase 20 and the cylinder block 21 by journal bearings 31. cylinders 32 directed horizontally in front-rear directions are disposed at regular intervals in a vertical direction. A piston 33 is fitted to each of the cylinders 3 to slide and connected to the crankshaft 30 by means of a connecting rod 34 so that reciprocation of the piston 33 causes the crankshaft 30 to be driven to rotate clockwise as viewed from above.

As shown in FIGS. 7 to 10, within a valve moving chamber 35, a cam shaft holder 36 is attached to a top face (rear face with respect to the ship body) of the cylinder head 22 and a cam shaft 38 is rotationally supported between the cam shaft holder 36 and the cylinder head 22 by a journal bearing 37. At the right and left with respect to the ship body of the cam shaft 38 are supported on the cam shaft holder 36 rocker shafts 39, 40 parallel with the cam shaft 38. On the rocker shafts 39, 40 are pivoted so as to swing rocker arms 41, 42 having tip ends contacted with an intake valve 43 and an exhaust valve 44 respectively. The cam shaft 38 is driven to rotate at a half numbers of revolution compared with the crankshaft 30. By a valve moving device 55 which is mentioned in the later part, the intake valve 43 and the exhaust valve 41 are driven to open and close intermittently every two revolutions of the crankshaft 30.

Figure 2:
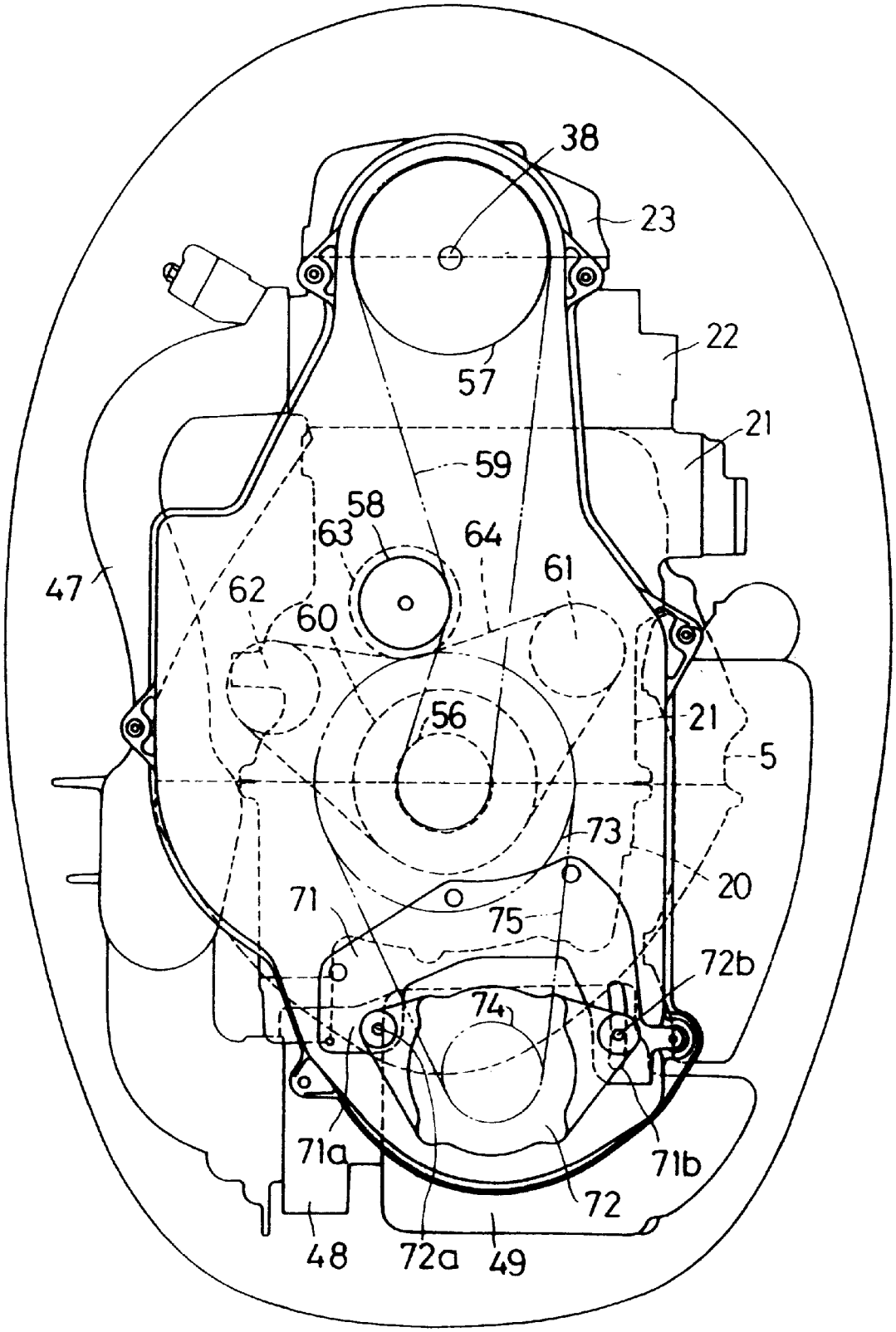
FIG. 2 is a plan view of the internal combustion engine.
Figure 8:
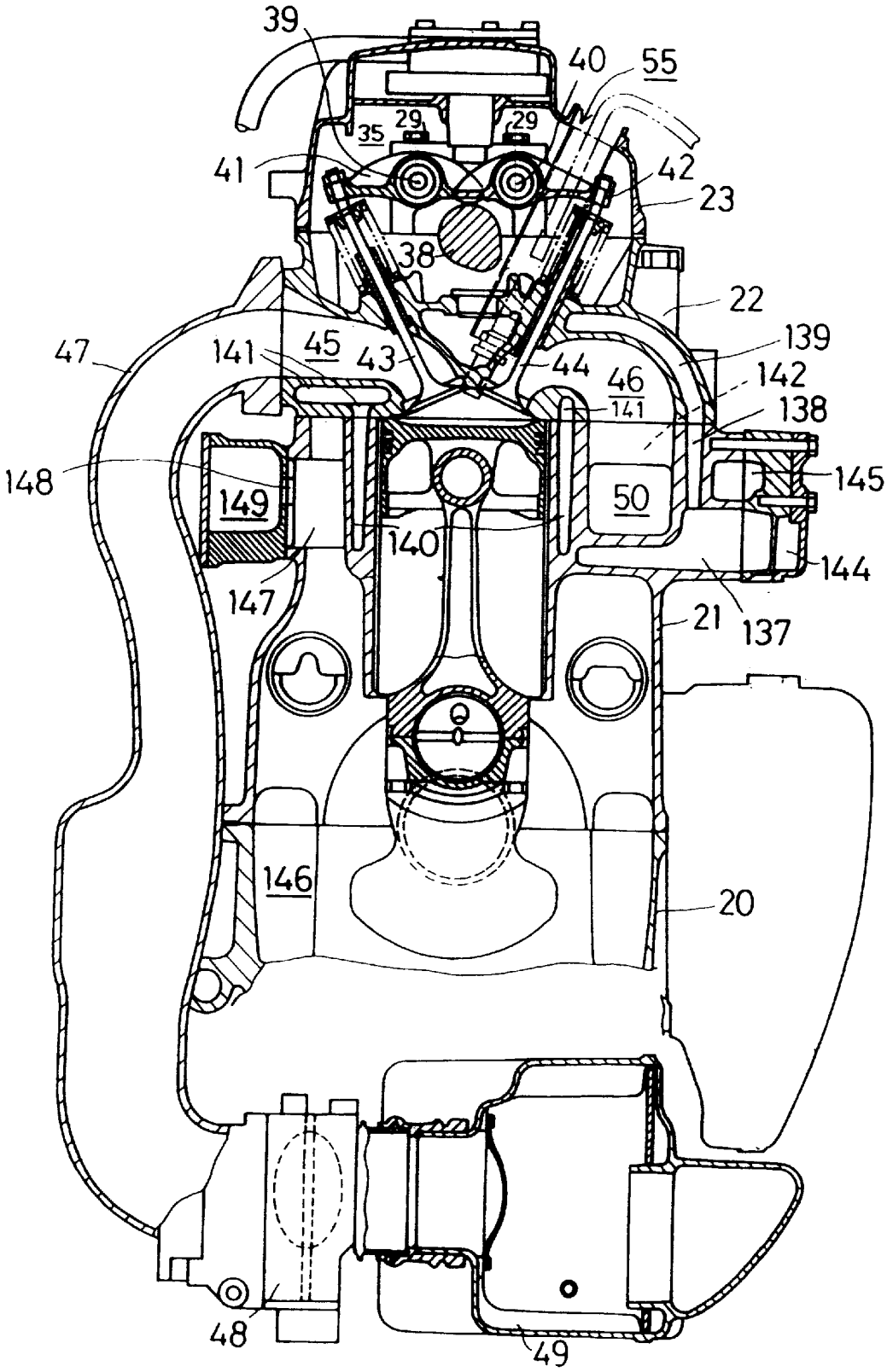
FIG. 8 is a section along the line VIII—VIII of FIG. 3.

As shown in FIG. 8, an intake passage 45 opened and closed by the intake valve 43 is connected with a lower stream end of an intake manifold 47 positioned on the right side with respect to the ship body (left side in FIG. 2). An upper stream end of the intake manifold 47 is connected with an intake chamber 49 through a throttle valve 49. The intake chamber 49 has an intake aperture (not shown) opening within the engine cover 2 so that air inhaled into the engine cover 2 through an intake aperture 2*a* (FIG. 1) is introduced into the intake chamber 49 and then to the intake passage 45 through the throttle valve 48 and the intake manifold 47.

Figure 11:
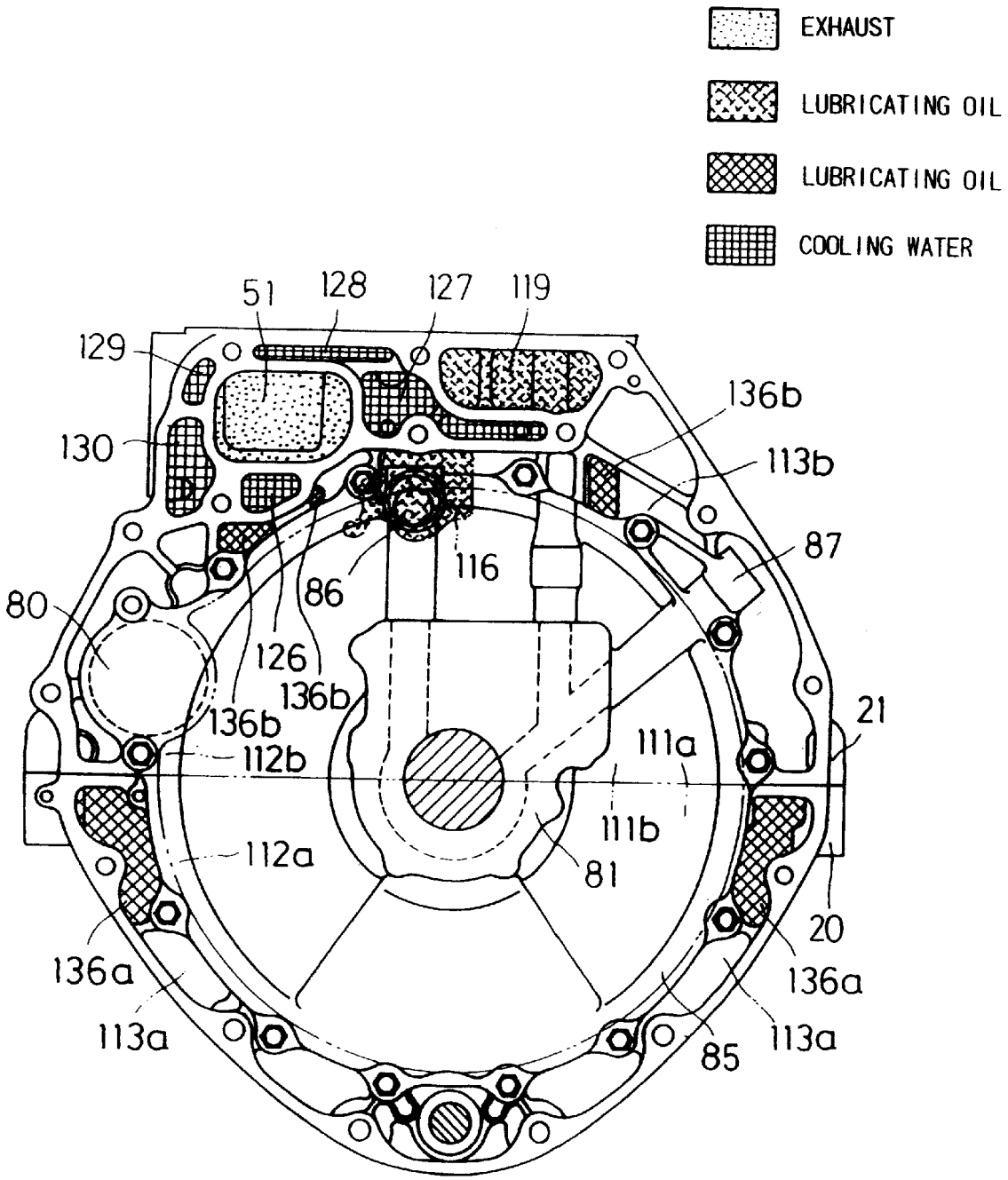
FIG. 11 is a view showing the crankcase and the cylinder block viewed from the bottom.
Figure 12:
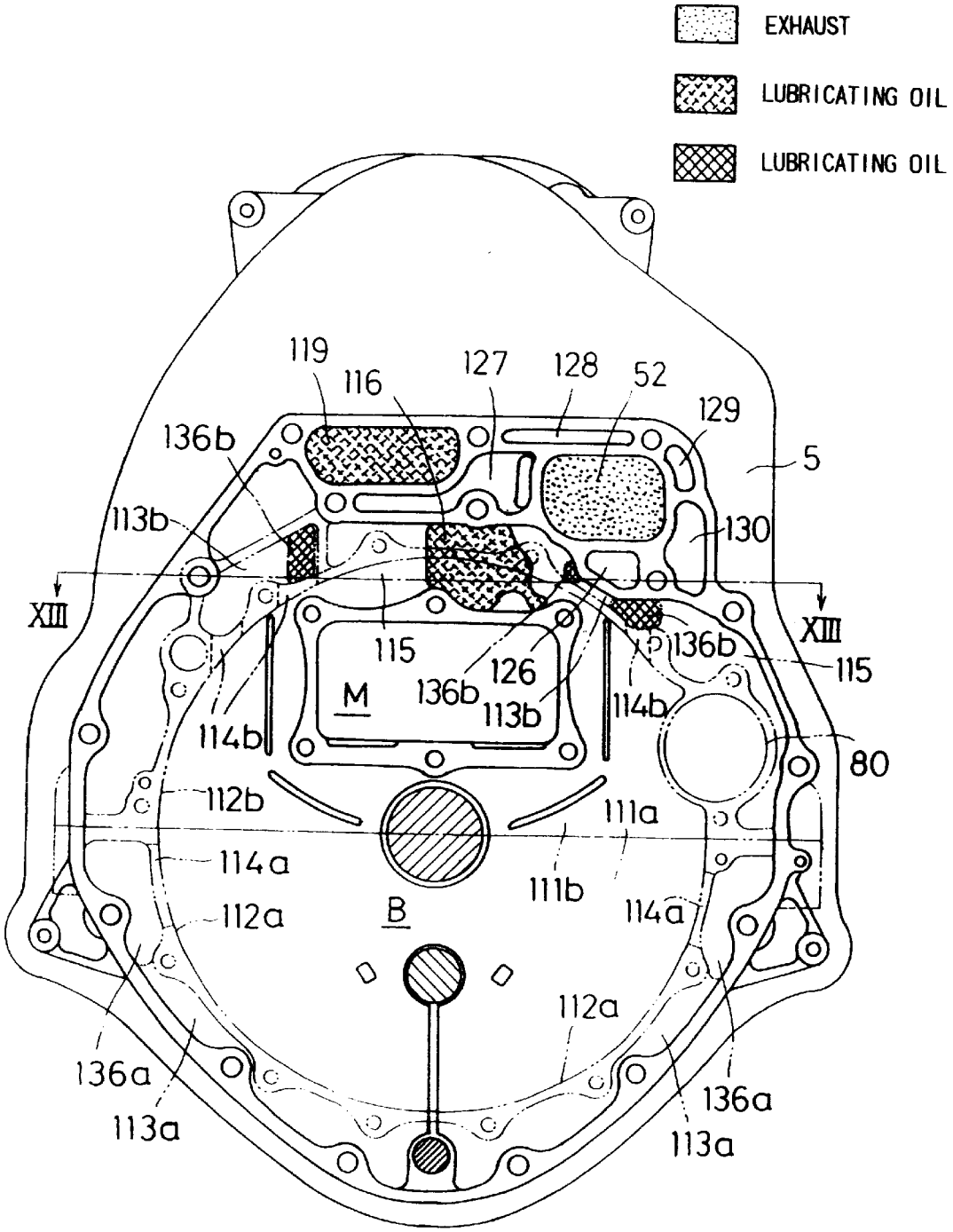
FIG. 12 is a plan view of a mount case.

An exhaust passage 46 opened and closed by the exhaust valve 44 is directed to the left side with respect to the ship body (right side in FIG. 8), bent at a lower stream end toward the cylinder block 21 (toward the front with respect to the ship body) and connected to an exhaust passage 50 directed in vertical direction within the cylinder block 21. As shown in FIGS. 11 and 12, the exhaust passage 50 opens to an exhaust hole 51 which communicates with an exhaust passage 52 of the mount case 5.

To a lower end of the exhaust passage 52 is connected an upper end of an exhaust pipe 53 (FIG. 1) having a lower end opening within the extension case 3. Exhaust gas discharged into the extension case 3 from the exhaust pipe 53 passes through a space within the gear case 4 to be discharged into the water through an exhaust passage 54 (FIG. 1).

The valve moving device 55 shown in FIG. 8 is disposed above the crankcase 20 and the cylinder block 21. Namely, as shown in FIGS. 2 and 4, a drive pulley 56 is integrally fitted to an upper part of the crankshaft 30, a driven pulley 57 is integrally fitted to an upper end of the cam shaft 20, an idler pulley 58 is pivotally supported on the cylinder block 21 and an endless belt 59 is wound round these pulleys 56, 57 and 58.

Figure 6:
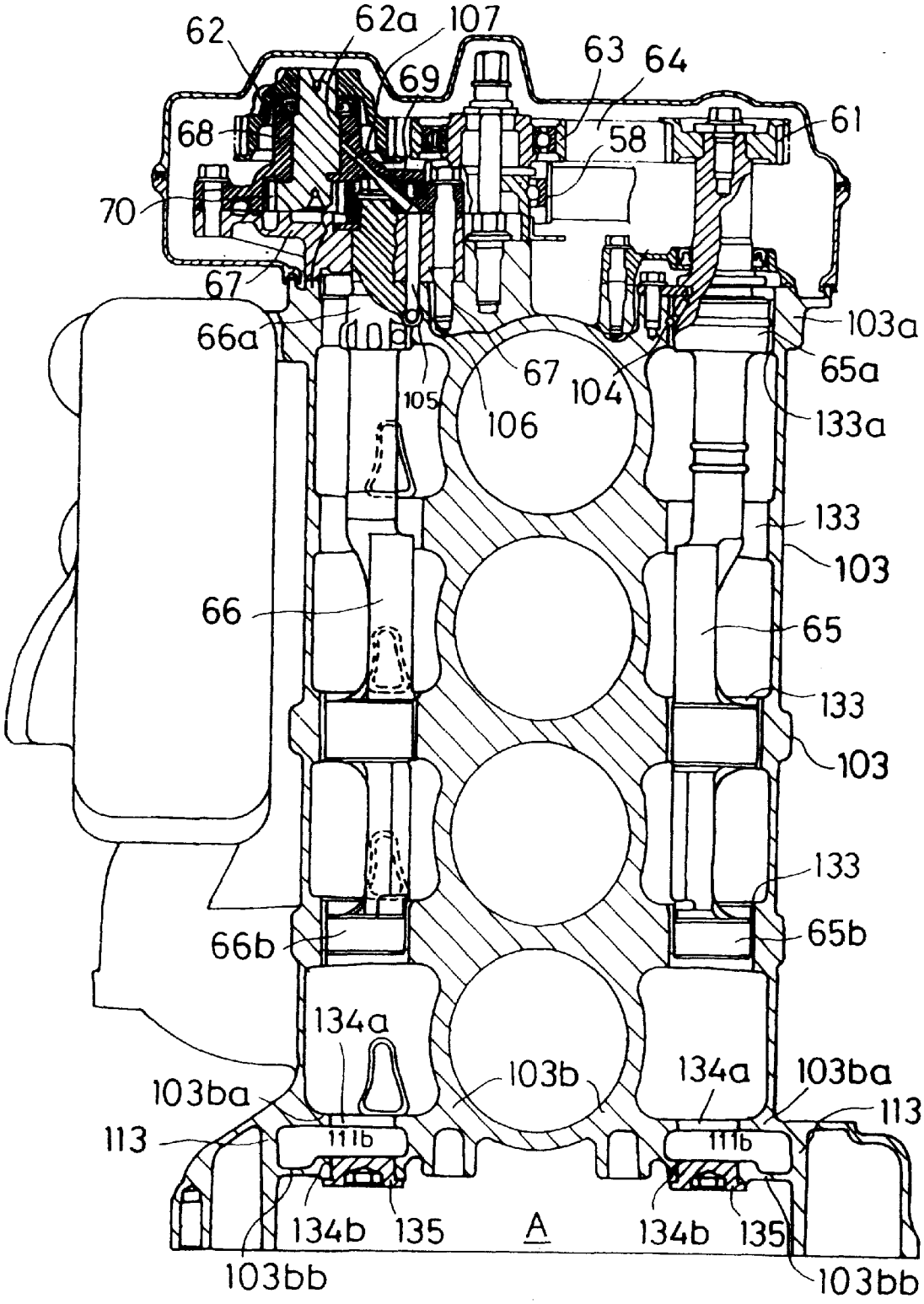
FIG. 6 is a front view showing a cross section along balancer shaft of the internal combustion engine.

Further, as shown in FIGS. 2, 4 and 6, a balancer drive pulley 60 is integrally fitted to the crankshaft 30 at a position above the drive pulley 56, balancer driven pulleys 61, 62 are provided so as to rotate freely positioned on the right and left of the cylinder 32, an idler pulley 63 concentric with the above-mentioned idler pulley 58 is pivotally supported and an endless belt 64 is wound round these pulleys 60, 61, 62 and 63.

As shown in FIGS. 2 and 6, the balancer driven pulley 61 on the left side with respect to the ship body (right side in FIGS. 2, 6) is integrally fitted to the left side balancer shaft 65 pivotally supported in the cylinder block 21. The other balancer shaft 66 disposed symmetrically with the balancer shaft 65 about the cylinder 32 has a lower portion pivotally supported by the cylinder block 21 and an upper portion pivotally supported by a balancer supporting bracket 67 and a bracket cover 68 attached to the bracket 67, and a drive gear 69 integral with the balancer shaft 66 and a driven gear 70 integral with the balancer driven pulley 62 are engaged with each other so that the balancer shafts 65, 66 are driven to rotate with the same revolutional speed but in opposite directions.

As shown in FIGS. 2 and 4, on an upper surface of the crankcase 20 are attached a bracket 71 having an end 71*a* on which an end 72*a* of an AC generator 72 is pivoted so as to swing. Another end portion 72*a* of the generator 72 is fitted movably in an arcuate groove 71*b* formed on another end portion of the bracket 71, and fixed to the bracket 71 by fixing means not shown. An endless belt 75 is wound round a drive pulley 73 integrally fitted to an upper end of the crankshaft 30 and a driven pulley 74 integrally fitted to an upper end of a rotary shaft of the AC generator 72.

Figure 5:
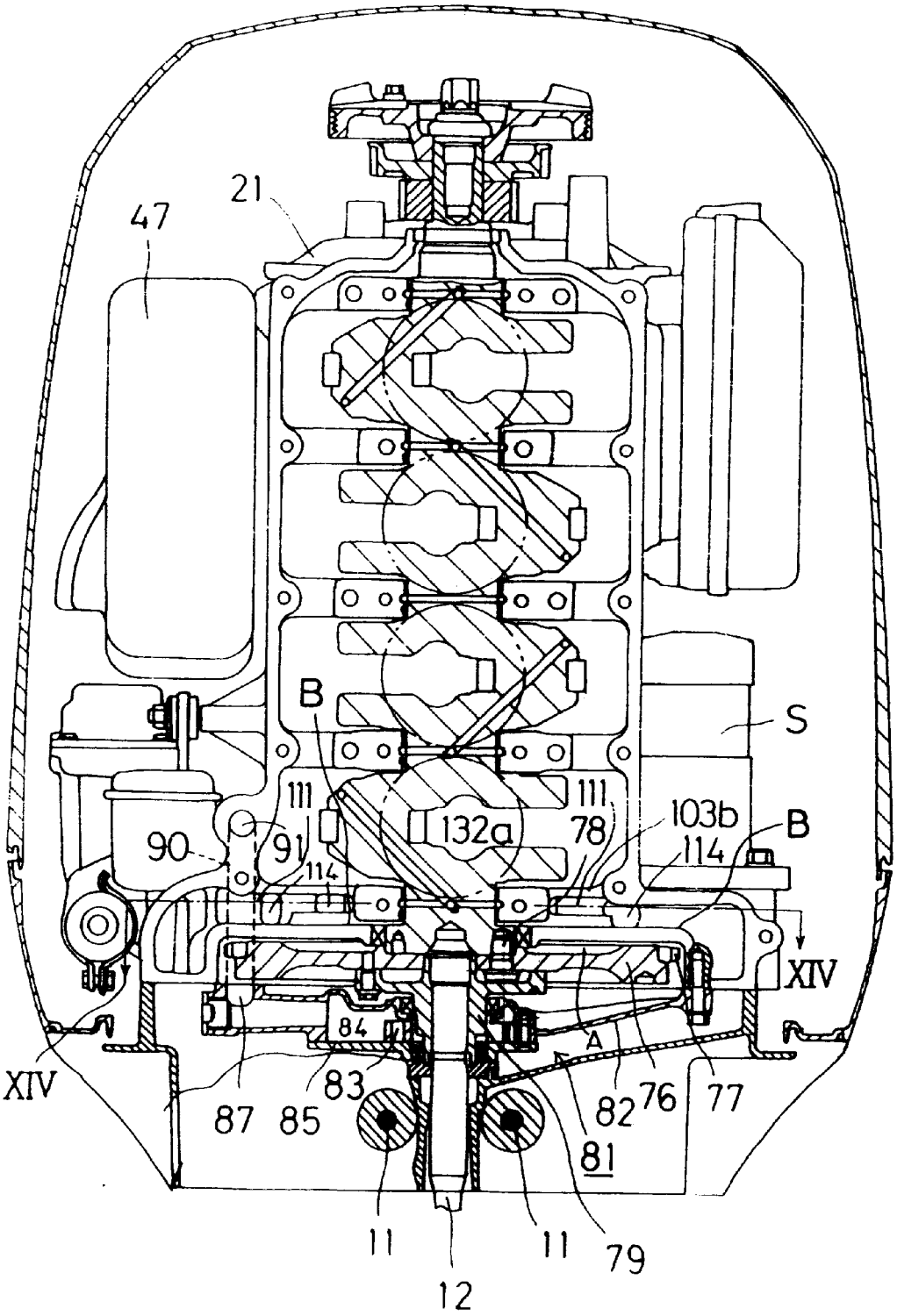
FIG. 5 is a front view of a joining surface of the cylinder block to the crankcase in the internal combustion engine.

Further, as shown in FIGS. 4 and 5, a flywheel 76 is integrally fitted by bolts 78 to a lower end of the crankshaft 30 and a ring gear 77 is formed on a circumference of the flywheel 76. On a lower surface of the flywheel is attached a connecting member 79 to which an upper end of the above-mentioned driving shaft 12 is fitted by means of splines. The ring gear 77 is engaged with a drive pinion (not shown) disposed in an arcuate recess 80 formed on a lower surface of the cylinder block 21 as shown in FIGS. 11, 12. When the drive pinion is rotated by a starter motor S shown in FIG. 5, the ring gear 77, the flywheel 76 and the crankshaft 30 are driven to rotate.

Next, the lubricating system of the vertical internal combustion engine 1 will be described.

As shown in FIG. 4, on lower surfaces of the crankcase 20 and the cylinder block 21 is provided an oil pump body 82 of an trochoid type lubricating oil pump 81 which has a rotor 83 integrally fitted to the connecting member 79, a pump chamber 84 closed by a lid 85 and a suction port 86 opening downward. A suction pipe 88 having an upper end connected with the suction port 86 extends downward within the oil pan 6 passing through a return oil hole 116. A strainer 89 is connected to a lower end of the suction pipe 88.

As shown in FIGS. 3, 5, 10 and 11, the lubricating oil pump 81 has a discharge port connected with a vertical oil passage 90 which is connected with a longitudinal horizontal oil passage 91 extending toward the crankcase in front and a longitudinal horizontal oil passage 92 within the crankcase in turn. To a front end of the longitudinal horizontal oil passage 92 is connected a lower end of a vertical oil passage 93 extending upward. An upper end of the vertical oil passage 93 is connected to a longitudinal horizontal oil passage 94 directed to the left (right in FIG. 3).

Figure 3:
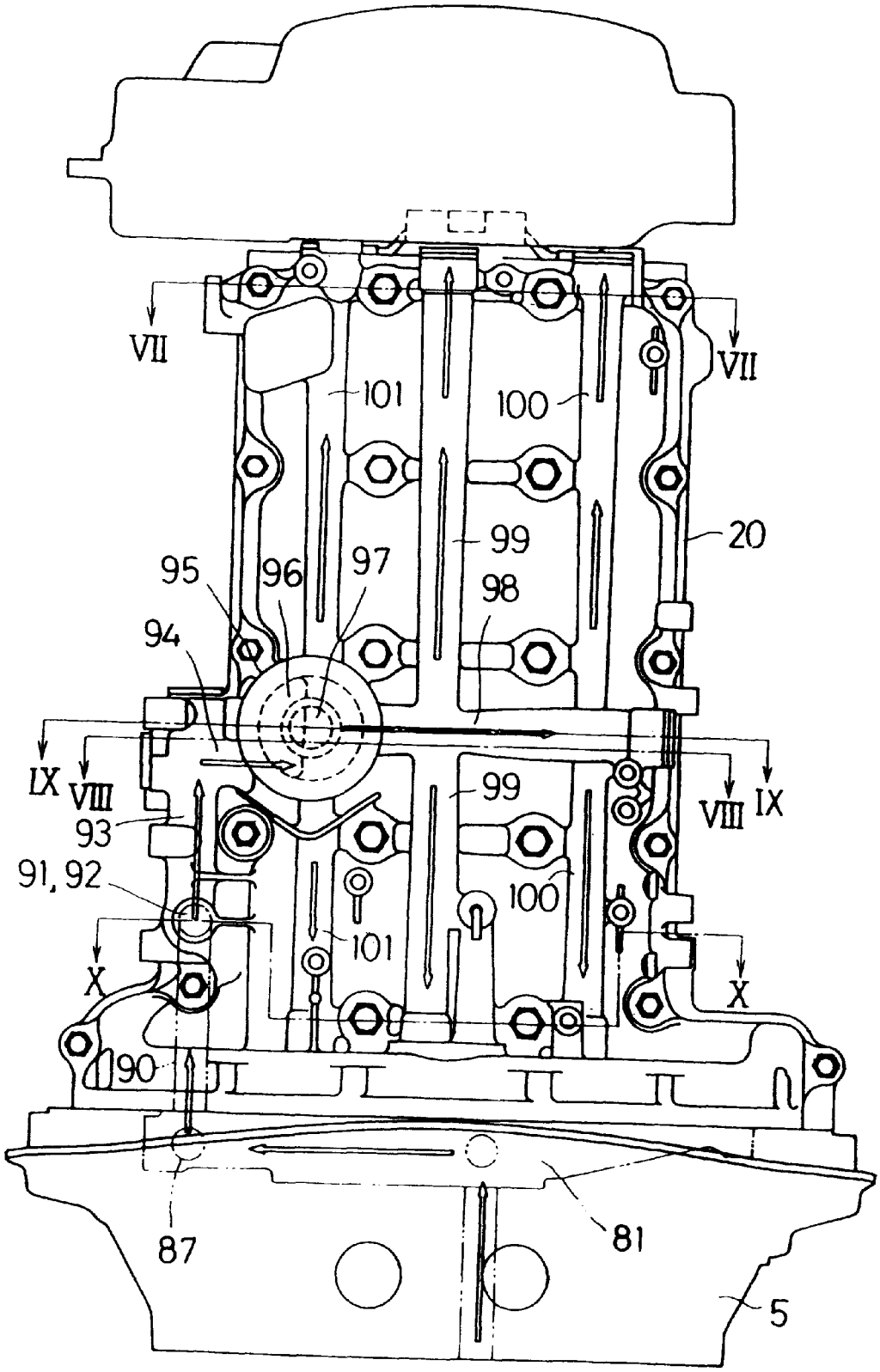
FIG. 3 is a front view of the internal combustion engine.
Figure 9:
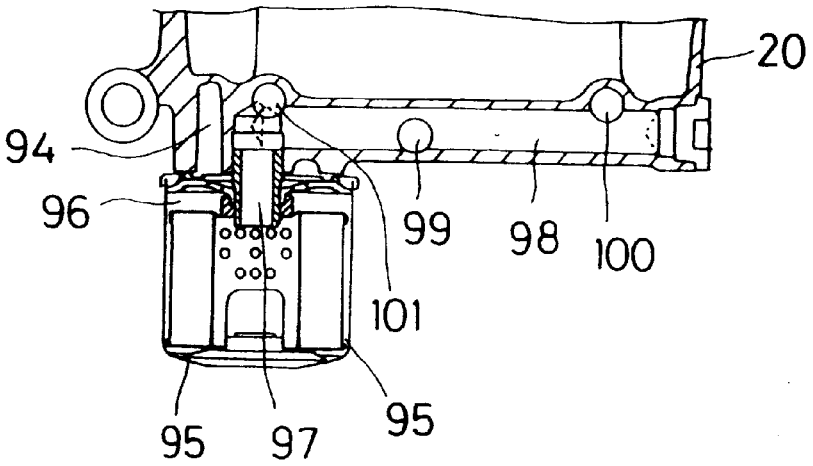
FIG. 9 is a section along the line IX—IX of FIG. 3.

Further, as shown in FIGS. 3 and 9, a left end of a longitudinal horizontal oil passage 94 is connected to an intake portion 96 of an oil filter 95 and a discharge portion 97 of the oil filter 95 is connected to a communication oil passage 98 directed to the left (right in FIG. 3) of the crankcase 20.

The communication oil passage 98 communicates with a crankshaft oil passage 99 directed vertically positioned at a center of the width and balancer shaft oil passages 100, 101 directed vertically positioned at right and left sides of the oil passage 99 respectively.

Figure 7:
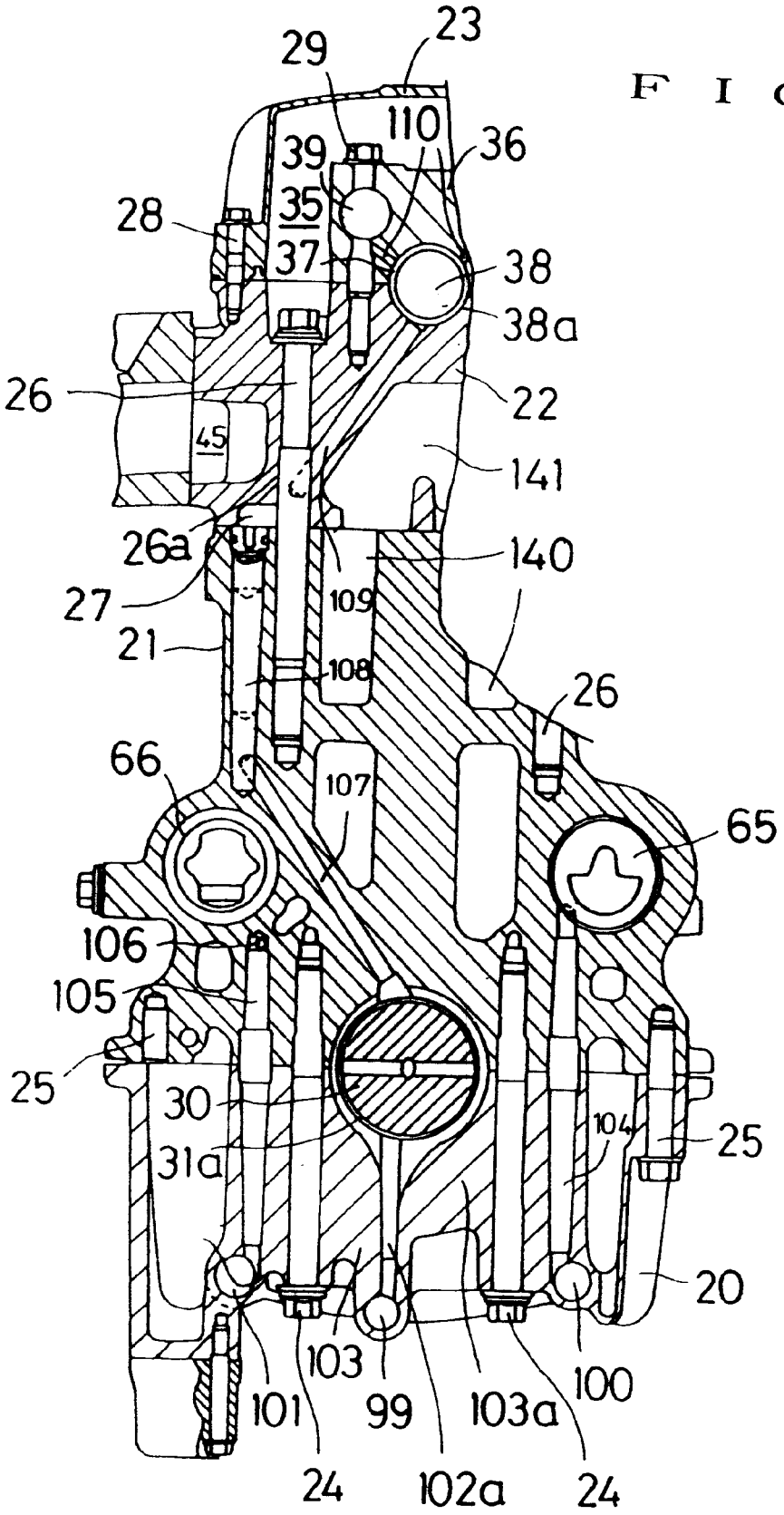
FIG. 7 is a section along the line VII—VII of FIG. 3.
Figure 10:
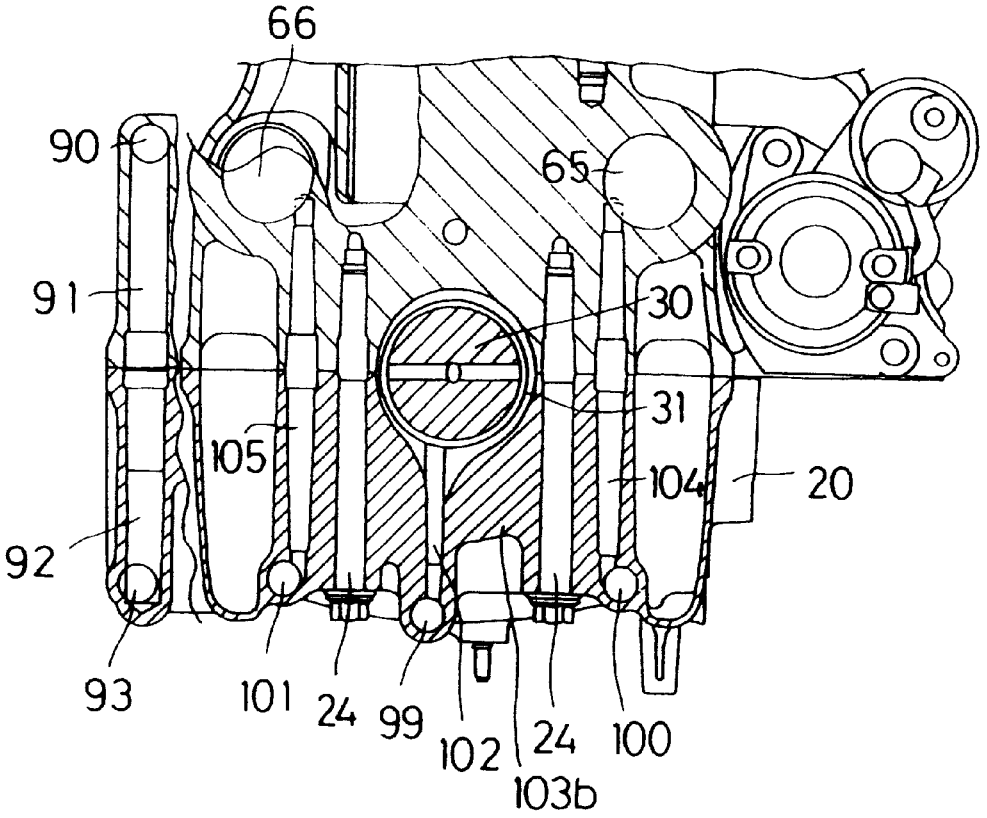
FIG. 10 is a section along the line X—X of FIG. 3.

As shown in FIGS. 7 and 10, a crankshaft oil passage 102 directed rearward horizontally is formed in each of the crankshaft supporting portions 103. A tip end of the crankshaft oil passage 102 communicates with the journal bearing 31 of the crankshaft 30, therefore the journal bearing 31 is lubricated with the lubricating oil pressurized and sent out by the lubricating oil pump 81, filtered by the oil filter 95 and brought through the above-mentioned oil passages.

In the uppermost crankshaft supporting portion 103*a* are formed balancer shaft oil passages 104, 105 directed rearward horizontally through the crankcase 20 and the cylinder block 21. The balancer shaft oil passages 194, 105 communicate with the above-mentioned balancer oil passages 100, 101 at the front ends (lower ends in FIG. 10) and with the balancer shafts 65, 66 at the rear ends (upper ends in FIG. 10).

As shown in FIG. 6, a pivot portion 65*a* at the upper end of the balancer shaft 65 is lubricated by the lubricating oil discharged from the rear end of the balancer shaft oil passage 104. The lubricating oil drops by gravity after lubricating the upper end pivot portion 65*a* and reaches a pivot portion 65*b* at the lower end of the balancer shaft 65 to lubricate the pivot portion 65*b*.

The rear end of the balancer shaft oil passage 105 is connected with the balancer shaft oil passage 106 in the cylinder block 21 and the balancer pivot bracket 67. The balancer shaft oil passage 106 is connected with the cam shaft oil passage 107 in the bracket cover 68 and the upper end of the cam shaft oil passage 107 is opened to the pivot portion 62*a* of the balancer driven pulley 62 to lubricate the pivot portion 62*a* too.

As shown in FIG. 7, in an upper part of the cylinder block 21 is formed a cam shaft oil passage 107 directed obliquely rearward horizontally. The cam shaft oil passage has a front end connected with the Journal bearing 31*a* at the uppermost crankshaft supporting portion 103*a* and a rear end connected with a front end of a cam shaft oil passage 108 directed rearward horizontally. A rear end of the cam shaft oil passage 108 is connected with a cam shaft oil passage 109 in the cylinder head 22 through a communication passage 27 of the cylinder head 22 and a hole 26*a* of the bolt 26 for connecting the cylinder head 22 to the cylinder block 21. A rear end of the cam shaft oil passage 109 opens to the pivot portion 38*a* of the cam shaft 38. A rocker oil passage 110 opening to the pivot portion 38*a* is formed in the cam shaft holder 36.

Thus, a part of the lubricating oil supplied to the uppermost journal bearing 3*a* is sent to the pivot portion 38*a* of the cam shaft 38 through the cam shaft oil passages 107, 108 and 109 to lubricate the pivot portion 38*a*. A part of the lubricating oil supplied to the pivot portion 38*a* is sent to center holes (not shown) of the rocker shafts 39, 40 through the rocker oil passage 110 and further to pivot portions (not shown) of the rocker arms 41, 42 to lubricate the pivot portions.

Figure 13:
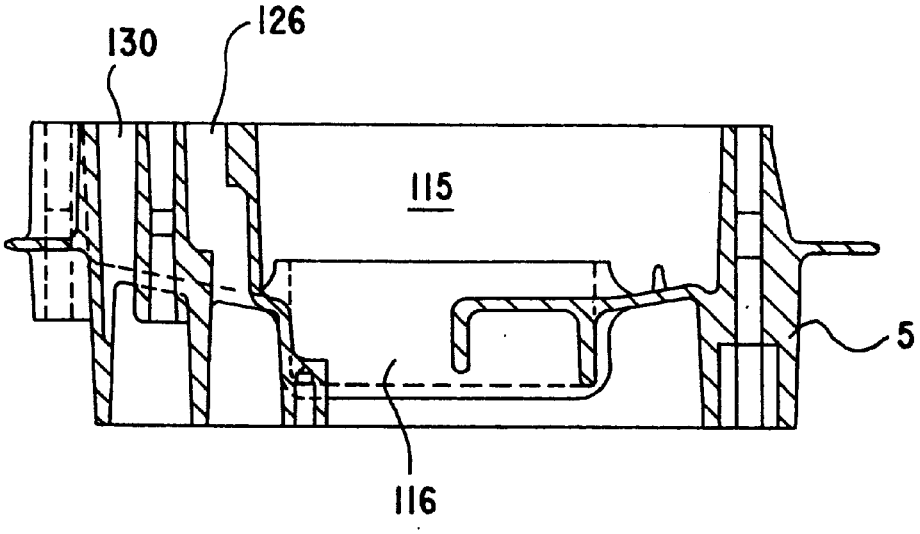
FIG. 13 is a section along the line XIII—XIII of FIG. 12.
Figure 14A:
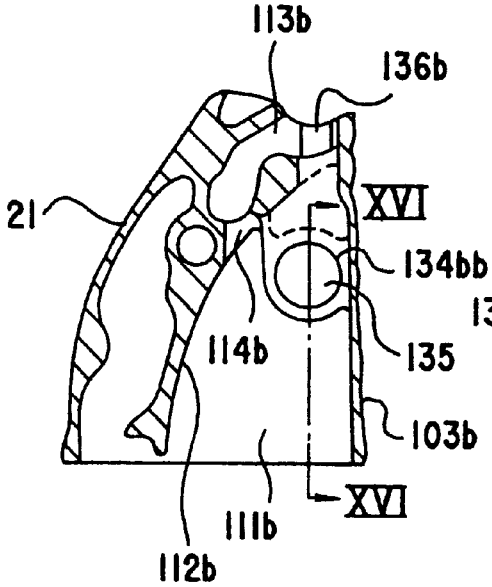
FIG. 14 is a section along the line XIV—XIV of FIG. 5.
Figure 14B:
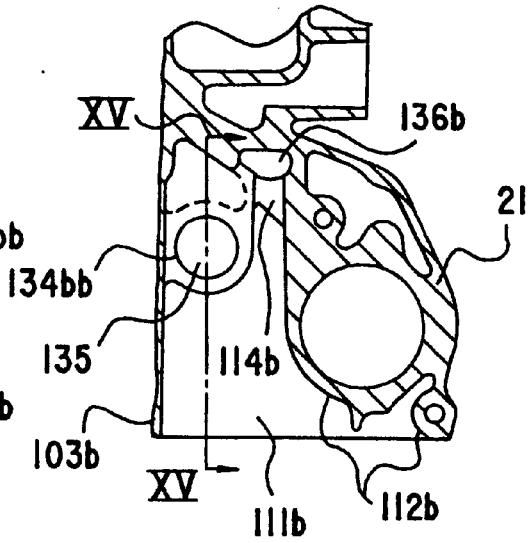
Figure 15:
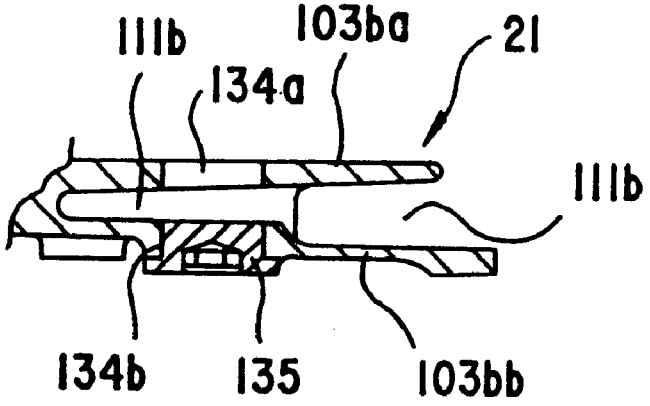
FIG. 15 is a section along the line XV—XV of FIG. 14.
Figure 16:
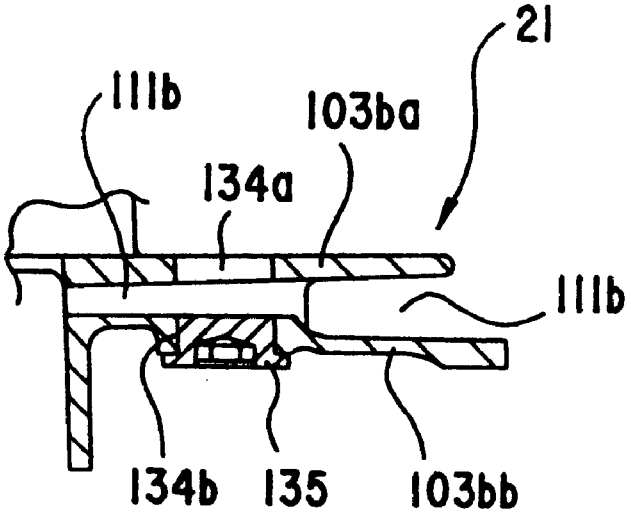
FIG. 16 is a section along the line XVI—XVI of FIG. 14.

As shown in FIGS. 5, 6, 14, 15 and 19, at vertically middle positions of the lowermost crankshaft supporting portions 103*b* in the crankcase 20 and the cylinder block 21, horizontal flat oil passage spaces 111*a*, 111*b* are formed (in the section of FIGS. 15, 16, only the flat oil passage space 111*b* on the cylinder block 21 side is shown). Peripheries of the flat oil passage spaces 111*a*, 111*b* of the crankcase 20 and the cylinder block 21 are bounded by partition walls 112*a*, 112*b* respectively, and as shown in FIGS. 12 and 14, the flat oil passage spaces 111*a*, 111*b* communicate with partitioned spaces 113*a*, 113*b* formed on the outside of the partition walls 112*a*, 112*b* through return oil passages 114*a*, 114*b*. Under the partitioned spaces 113*a*, 113*b* are formed vertical communication holes 136*a*, 136*b* which communicate with a partitioned space 115 formed in the mount case 5 (FIGS. 12, 13). Under the partitioned space 115 is formed a return oil hole 116 communicating with a space within the oil pan.

As shown in FIGS. 1 and 4, the valve moving chamber 35 surrounded by the cylinder head 22 and the head cover 23 communicates with an oil passage space 119 of the mount case 5 through a return oil hole 117 of the cylinder head 22 and a return oil passage 118 of the cylinder block 21, as well as through a communication pipe 120. The lower end of the oil passage space 119 is closed by a lid 121 which is penetrated by a return oil pipe 122 communicating with the oil passage space 119. The return oil pipe 122 has an upper end connected to the lid 121 and a lower end opening to a bottom portion of the oil pan 6.

As shown in FIG. 6, pivot holes 133 for inserting the balancer shafts 65, 66 are worked in the crankshaft supporting portions 103 by inserting a tool (not shown) from the uppermost crankshaft supporting portion 103*a* downward. In upper and lower partition walls 103*ba*, 103*bb* of the lowermost crankshaft supporting portion 103*b* are formed work holes 134*a*, 134*b* smaller than the pivot holes 133. The work hole 134*b* in the lower partition wall 103*bb* is closed by a plug 135 to tightly separate the oil passage space 111*b* from the lower space A for the flywheel.

The cooling system of the vertical internal combustion engine 1 will be described. As shown in FIG. 1, a cooling water pump 123 driven by the driving shaft is provided at a joint part between the extension case 3 and the gear case 4. In a side wall of the gear case 4 is formed a suction port 124 with a net (not shown) stretched. Water entering into the gear case 4 through the suction port 124 is sucked by the cooling water pump 123 and sent to the vertical internal combustion engine 1 through a suction pipe 125.

As shown in FIGS. 11 and 12, cooling water rising passages 126, 127, 128, 129 and a cooling water descending passage 130 are formed in the mount case 5 and the cylinder block 21 positioned around the exhaust passage 52 passing through the mount case 5 vertically and the exhaust hole 51 communicating with the exhaust passage 52 and passing through the cylinder block 21 vertically.

Figure 17:
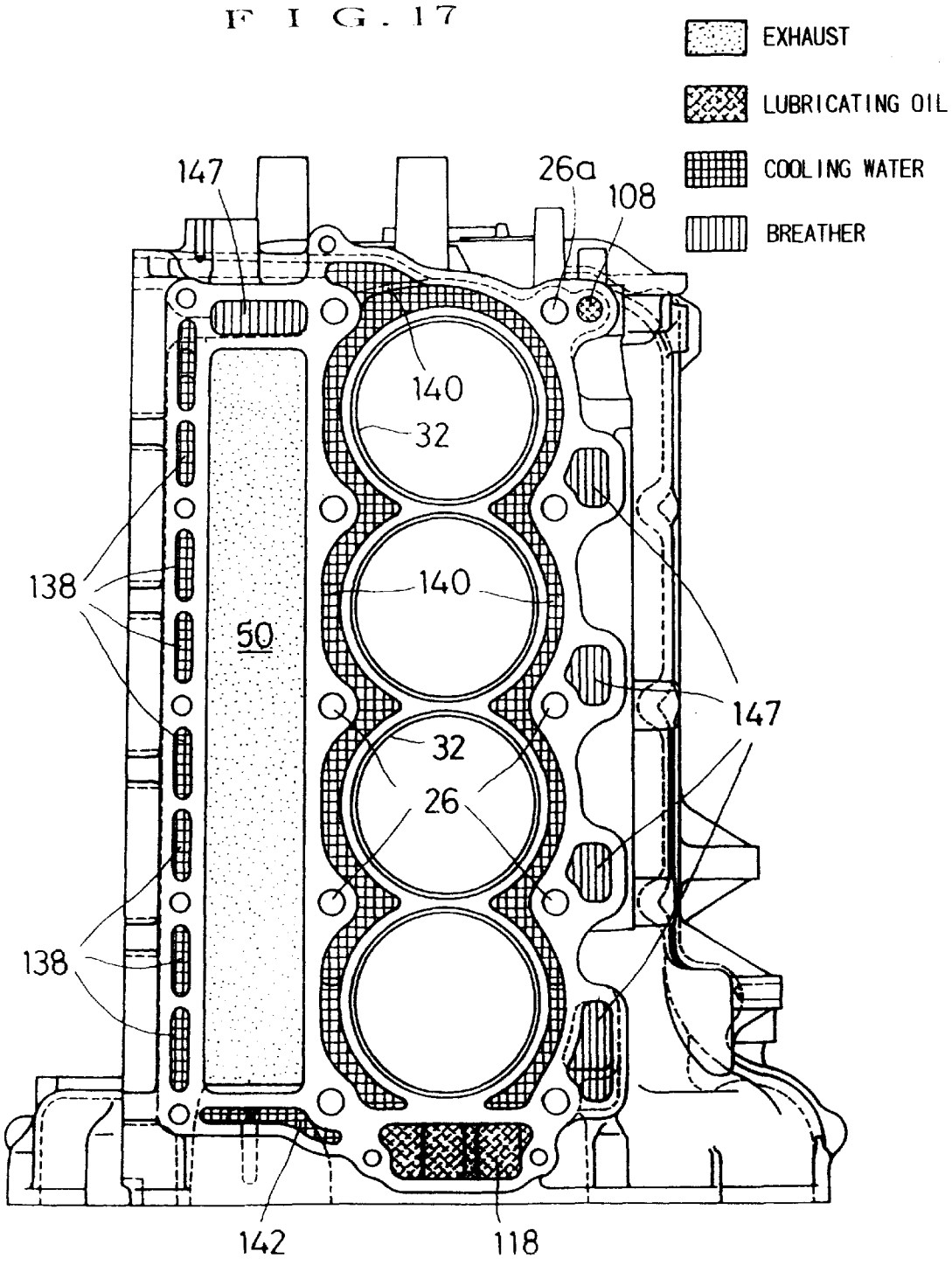
FIG. 17 is a view showing a joining face of the cylinder block.

In the cylinder block 21, a cooling water passage 137 (FIG. 8) communicating with the cooling water rising passage 126 of the mount case 5 (FIGS. 11, 12) is formed. As shown in FIGS. 8 and 17, the cooling water passage 137 communicates with a cooling water passage 138 on the outside of the exhaust passage 50 and the passage 138 communicates with a cooling water passage 139 of the cylinder head 22.

The cylinder block 21 is formed with a water jacket 140 communicating with the cooling water rising passage 127 of the mount case 5. An opening end of the water jacket 140 communicates with a cooling water passage 141 of the cylinder head 22 as shown in FIGS. 7 and 8.

Figure 18:
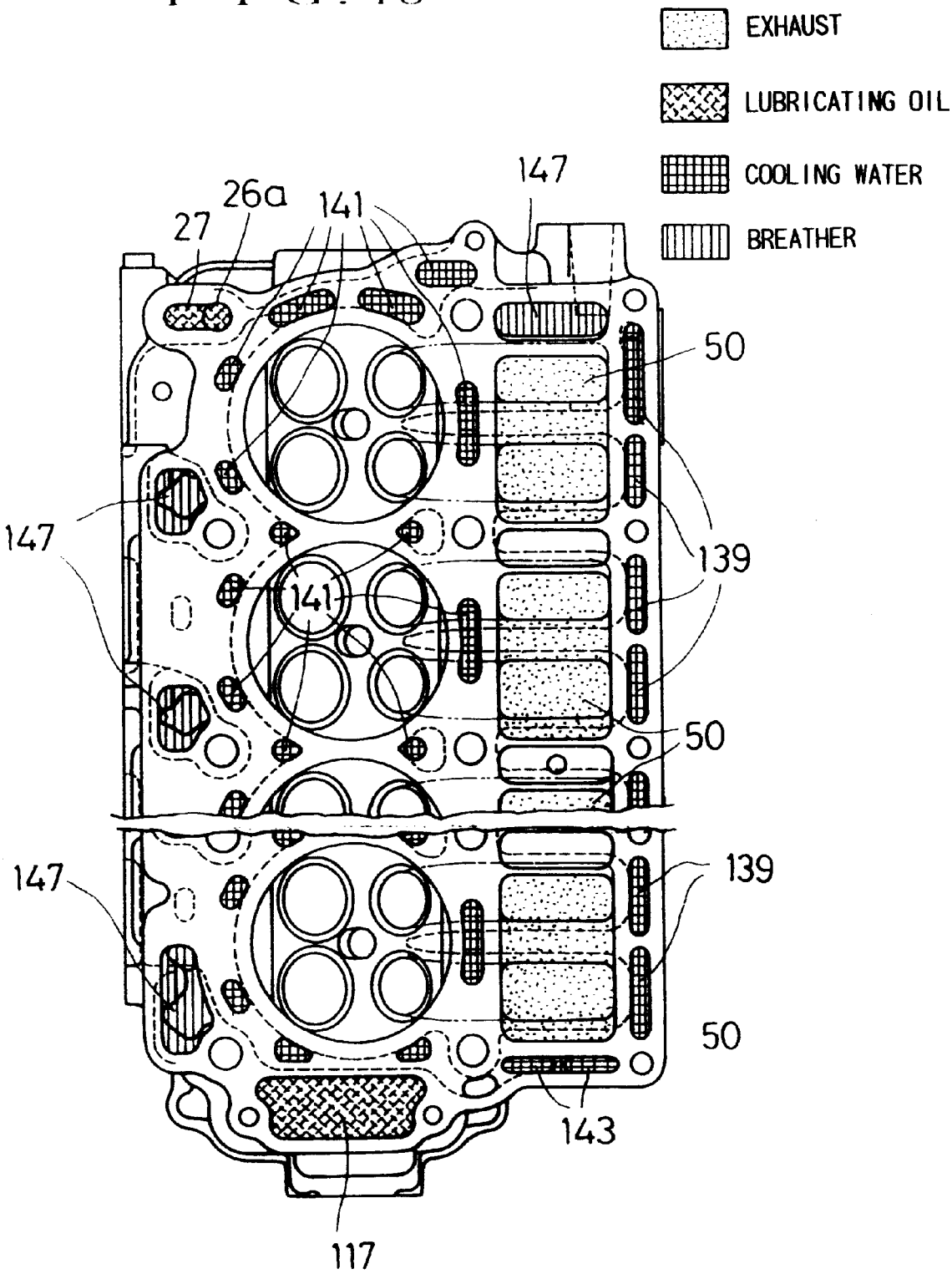
FIG. 18 is a view showing a joining face of the cylinder head.

Further, the cylinder block 21 is formed with a cooling water passage 142 at a position near the joint portion of the cylinder block and the cylinder head 22 with respect to the exhaust passage 50 and the aforementioned cooling water rising passage 128 of the mount case 5 communicates with the cooling water passage 142. A cooling water passage 143 communicating with the cooling water passage 142 is formed in the cylinder head 22 (FIG. 18).

As shown in FIG. 8, in the cylinder block 21, a cooling water passage 144 is formed on the outside of the cooling water passage 137 communicating with the cooling water rising passage 129, and in the neighborhood of the cooling water passages 137, 138, 144 is formed a cooling water passage 145 which communicates with the cooling water descending passage 130. The cooling water sent out from the cooling water pump 123 is supplied to the cooling water passages 139, 141, 143 of the cylinder head 22 through the cooling water passages 126, 127, 128, 129 of the mount case 5, and the cooling water passages 137, 138, 142, 144 of the cylinder block 21, then discharged outside through the cooling water passage 145 of the cylinder block 21 and the cooling water descending passage 130 of the mount case 5.

As shown in FIG. 8, a breather passage 147 communicating with the crank chamber 136 and the valve moving chamber 35 is connected with a breather chamber 149 through a hole 148.

When the vertical internal combustion engine 1 is started and becomes in an operation state, the crankshaft 30 and the rotor 38 of the lubricating oil pump 81 integrally fitted to the crankshaft rotate and lubricating oil in the oil pan 6 is sucked into the pump chamber 84 through the strainer 89, the suction pipe 88 and the suction port 86. Then the lubricating oil is sent to the intake portion 96 of the oil filter 95 through the vertical oil passage 90, the longitudinal horizontal oil passages 91, 92, the vertical oil passage 93 and the longitudinal horizontal oil passage 94 to be filtered by the oil filter 95. After that, the lubricating oil is supplied to the crankshaft oil passage 99, the balancer shaft oil passage 100 and the balancer oil passage 101 through the communication oil passage 98.

The lubricating oil supplied to the crankshaft oil passage 99 is sent to the journal bearing 31 of the crankshaft 30 to lubricate it, through the crankshaft oil passage 102 provided in the crankshaft supporting portion 103 directing rearward as shown in FIGS. 7 and 10.

Referring to FIG. 4, the lubricating oil which has lubricated any journal bearing 31 flows down passing through communication holes 131 formed in the crankshaft supporting portions 103 in turn until it reaches the lowermost crankshaft supporting portion 103*b* and flows into the flat oil passage space 111*b*. Referring to FIG. 12, the lubricating oil in the flat oil passage space 111*b* drops onto an upper surface of the mount case 5 through the return oil hole 114*a*, the partitioned space 113*b* and the vertical communication hole 136*b*.

Another lubricating oil flowing into the flat oil passage space 111*a* of the lowermost crankshaft supporting portion 103*a* in the same manner as the above, drops onto an upper surface of the mount case 5 through the partitioned space 113*a* and the vertical communication hole 136*a*. The lubricating oil on the upper surface of the mount case 5 drops in the oil pan 6 through the return oil passage 116 provided in the mount case 5 (FIGS. 12, 13).

Referring to FIG. 7, a part of the lubricating oil supplied to the journal bearing 31*a* of the crankshaft 30 to lubricate it through the crankshaft oil passage 102*a* of the uppermost crankshaft supporting portion 103*a* is further supplied to a portion 38*a* to be lubricated of the cam shaft 38 through the cam shaft oil passages 107, 108, 109 for lubricating the portion 38*a*. The lubricating oil is supplied in the cam shaft 38 through the rocker oil passage 110 to lubricate friction parts of the valve moving device, collects in the valve moving chamber 35, flows into the oil passage space 119 of the mount case 5 through the return oil passages 117, 118 as well as the communication pipe 120 parallel with the return oil passages, and then returns to the bottom of the oil pan 6 through the return oil pipe 122 (FIG. 4).

Another lubricating oil entering the balancer shaft oil passages 100, 101 from the communication oil passage 98 flows through the balancer shaft oil passages 104, 105 (FIGS. 7, 9, 10) to lubricate the upper portions 65*a*, 66*a* of the balancer shafts 65, 66 (FIG. 6), then the lubricating oil goes down by gravity and lubricates the lower pivot portions 65*b*, 66*b* of the balancer shafts 65, 66. Thus if only the balancer shaft passages 104, 105 are provided to the balancer shafts 65, 66 respectively, middle bearing portions and lower end bearing portions of the balancer shafts 65, 66 are also lubricated so that the balancer lubricating system is simplified greatly and cost can be reduced.

Referring to FIG. 6, a lubricating oil flowing into the balancer shaft oil passage 106 from the balancer shaft oil passage 105 is supplied to the pivot portion 62*a* of the balancer driven pulley 92 through the cam shaft oil passage 107 to lubricate the pivot portion 62*a* with the very simple lubricating construction.

The lubricating oil which has lubricated the balancer shafts 65, 66 drops down and flows into the oil passage space 111*b* through the work hole 134*a* of the lowermost crankshaft supporting portion 103*b*. The lubricating oil in the oil passage space 111b returns into the oil pan 6 through the return oil hole 114*b*, the partitioned space 113*b* (FIG. 14), the partitioned space 115 and the vertical communication hole 136 (FIG. 13) in turn.

Since the pivot hole 133*a* pivotally supporting the upper end of the balancer shaft 65 (66) at the uppermost crankshaft supporting portion 103*a*, the pivot holes 133 in the middle crankshaft supporting portions 103 which the balancer shaft passes through, the work hole 134*a* pivotally supporting the lower end of the balancer shaft at the lowermost crankshaft supporting portion 103*b* and the work hole 134*b* formed under the hole 134*a*are arranged in a straight line as shown in FIG. 6, these holes can be worked easily by a tool. Particularly the upper pivot holes 133 can be finished by a tool having a lower end supported by the work holes 134*a*, 134*b* with a high productivity. Since the plug 135 is fitted in the lower work hole 134*b*, lubricating oil in the oil passage space 111 never flows into the flywheel space A under the space 111.

As shown in FIGS. 7, 17 and 18, the cam shaft oil passages 107, 108, the communication passage 27, the hole 26*a* for inserting the bolt 26 and the cam shaft oil passage 109 leading to the pivot portion 38*a* of the cam shaft 38 from the uppermost journal bearing 31*a* of the crankshaft 30 are arranged on the opposite side to the exhaust passage 50, so that lubricating oil passing through these oil passages is hardly heated and prevented from deterioration.

The bolts 26 are disposed at positions apart by substantially equal distances from the center of each cylinder 32 and substantially at regular intervals round the cylinder, therefore, even if diameters of the cylinders 32 are enlarged in order to make the vertical internal combustion engine 1 large-sized, contact surfaces around the cylinders of the cylinder block 21 and the cylinder head 22 can be pressed evenly against each other.

What is claimed is:

1. A vertical internal combustion engine having a cylinder block containing a crankshaft directed substantially in a vertical direction and a plurality of cylinders arranged along a vertical plane including the crankshaft, comprising:

a pair of balancer shafts drivingly connected to said crankshaft, and being pivotally supported in said cylinder block and disposed in parallel with said crankshaft on opposite sides of said cylinders;

pivot holes for pivotally supporting each balancer shaft being formed at uppermost and intermediate crankshaft supporting portions of said cylinder block passing through crankshaft supporting portions on said cylinder block;

a work hole for working said pivot holes formed in a lowermost crankshaft supporting portion of said cylinder block positioned in axial alignment with a center line of said pivot holes; and a removable plug closing said work hole tightly;

wherein a lowermost crankshaft supporting portion is divided into an upper wall and a lower wall between which an oil passage space is interposed, said lower wall extending radially slantingly downward and only the work hole is closed by said plug.

2. A vertical internal combustion engine having a cylinder block containing a crankshaft directed substantially in a vertical direction and a plurality of cylinders arranged along a vertical plane including the crankshaft, comprising:

a pair of balancer shafts drivingly connected to said crankshaft, and being pivotally supported in said cylinder block and disposed in parallel with said crankshaft on opposite sides of said cylinders;

pivot holes for pivotally supporting each balancer shaft being formed at uppermost and intermediate crankshaft supporting portions of said cylinder block passing through crankshaft supporting portions on said cylinder block;

a lubricating oil supply means being provided at said pivot hole of said uppermost crankshaft supporting portion;

a work hole for working said pivot holes formed in a lowermost crankshaft supporting portion of said cylinder block positioned in axial alignment with a center line of said pivot holes; and a removable plug closing said work hole tightly, wherein said lowermost crankshaft supporting portion is divided into an upper wall and a lower wall between which an oil passage space is interposed, said lower wall extends radially slating downward and only the work hole of said lower wall is closed by said plug.

3. A vertical internal combustion engine as claimed in either one of claim 1 or claim 2, comprising a balancer shaft driving means for transmitting power from said crankshaft to said balancer shaft.

* * * * *